US007854048B2

(12) United States Patent
Ota

(10) Patent No.: US 7,854,048 B2
(45) Date of Patent: Dec. 21, 2010

(54) HANDICRAFT ASSISTING TOOL

(75) Inventor: Hiroko Ota, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 312 days.

(21) Appl. No.: 12/287,066

(22) Filed: Oct. 6, 2008

(65) Prior Publication Data

US 2009/0288278 A1 Nov. 26, 2009

(30) Foreign Application Priority Data

May 20, 2008 (JP) ..... 2008-132006

(51) Int. Cl.
*D04D 7/04* (2006.01)
*A41H 33/00* (2006.01)

(52) U.S. Cl. ..... 28/147; 28/143; 223/38

(58) Field of Classification Search ..... 28/147, 28/143, 140, 149, 150, 142, 164, 163; 223/33, 223/34, 35, 37, 38, 44, 46; 33/562, 563, 33/566, 567, 565, 485, 2 R, 11–14; 112/120, 112/147; 428/4, 5; 229/108.1, 117.01, 117.05–117.08
See application file for complete search history.

(56) References Cited

U.S. PATENT DOCUMENTS 2,802,278 A * 8/1957 Knefel ..... 33/562
3,454,203 A * 7/1969 Nelson ..... 223/34
3,664,026 A * 5/1972 Lawson ..... 33/759
3,974,946 A * 8/1976 Gentry ..... 223/34
4,580,352 A * 4/1986 Wilson ..... 33/563
4,919,980 A * 4/1990 Pirkey ..... 428/4
5,137,190 A * 8/1992 Plaud ..... 223/33
6,360,927 B1 * 3/2002 Barker ..... 223/37
6,935,557 B2 * 8/2005 Aubry et al. ..... 229/235
6,964,110 B2 * 11/2005 Shapiro ..... 33/458
7,281,337 B1 * 10/2007 Oehlke et al. ..... 33/566
7,448,142 B2 * 11/2008 Geier ..... 33/566
2010/0162581 A1 * 7/2010 Ward ..... 33/566

OTHER PUBLICATIONS

Noriko Endo. "How to Make Casual Flowers with Ribbons and Fabrics". Bunka Publishing Bureau, p. 49.

* cited by examiner

*Primary Examiner*—Amy B Vanatta
(74) *Attorney, Agent, or Firm*—Hamre, Schumann, Mueller & Larson, P.C.

(57) ABSTRACT

A handicraft assisting tool is used for stitching a fabric having a first face and second face into a pouch. This handicraft assisting tool has a first plate and a second plate that collaborates with the first plate. The first plate has a plurality of rhombic unit pieces of the same size arranged in a row, and an inner face abutting on the first face of the fabric. The second plate has a plurality of rhombic unit pieces of the same size arranged in a row, and an inner face abutting on the second face of the fabric. Each of the unit pieces of the first and second plates is of the same size. The first plate and the second plate are each provided with folding operation instructions for folding these plates along a diagonal line of each unit piece and a borderline between adjacent unit pieces.

7 Claims, 10 Drawing Sheets

HANDICRAFT ASSISTING TOOL

BACKGROUND OF THE INVENTION

1. Field of the Invention

The present invention relates to a handicraft assisting tool, and particularly to a handicraft assisting tool for use in creating flower-shaped fashion accessories.

2. Description of the Related Art

A flower-shaped fashion accessory called "coil rose" has been conventionally known. The coil rose can be created as follows. First, a fabric material is cut to make rectangular fabrics. Next, peripheral edges of these fabrics are stitched together to form an elongated pouch. Finally, this pouch-like fabric is wrapped around a rod-like core material and then fixed with an adhesive to keep the shape of the entire fabric (for more detailed creating process, see, for example, Noriko Endo, "How to make casual flowers with ribbons and fabrics," Bunka Publishing Bureau).

In the creation method described above, the fabric material is preferably cut along a bias direction. By cutting in this manner, bulky feeling can be obtained when wrapping the pouch-like fabric, whereby a three-dimensional rose resembling an actual rose can be obtained.

The above-described method for creating a conventional coil rose has the following problems. Firstly, when creating a plurality of coil roses, it is difficult to closely align and stitch the peripheral edges of rectangular fabrics together to form a pouch, and therefore the peripheral edges become misaligned easily. As a result, pouch-like fabrics with variable shapes and sizes are obtained, resulting in uneven shapes of coil roses. Secondly, unlike when cutting a fabric in a direction of vertical or horizontal yarns, cutting a fabric in a bias direction can incur waste of the fabric, involving inefficient use of the material.

SUMMARY OF THE INVENTION

The present invention has been proposed in view of the above circumstances. Thus, an object of the present invention is to provide a handicraft assisting tool for use in creating fashion accessories including a coil rose, the handicraft assisting tool being capable of efficiently creating a pouch-like fabric of a fixed shape and size.

According to the present invention, a handicraft assisting tool for stitching a fabric having a first face and second face into a pouch is provided. This handicraft assisting tool has a first plate and second plate. The first plate has a plurality of rhombic unit pieces of the same size that are arranged in a row, and an, inner face that abuts on the first face of the fabric. Similarly, the second plate has a plurality of rhombic unit pieces of the same size that are arranged in a row, and an inner face that abuts on the second face of the fabric. Each of the unit pieces of the first plate is of the same size as each of the unit pieces of the second plate. The first plate and second plate are each provided with folding operation instructions for appropriately folding these plates along a diagonal line of each unit piece and a borderline between adjacent unit pieces.

Preferably, the folding operation instructions comprise folding indication lines that are shown along the diagonal line and the borderline, while also comprising folding direction indication marks that are shown to have the folding indication line therebetween, for showing folding directions of the folding indication lines.

Preferably, the folding operation instructions comprise folding creases that are provided along the diagonal line and the borderline to form either a mountain fold or a valley fold.

Preferably, the first plate has an end portion in which a pair of first through-holes is formed, and the second plate has an end portion in which a pair of second through-holes is formed. The first through-holes are configured so as to communicate with the second through-holes in a state in which the first plate and the second plate overlap each other.

Preferably, the inner faces of the first plate and second plate are each provided with a slip stopper.

Preferably, the first plate has an outer face on the side opposite to the inner face of the first plate, and this outer face is provided with stitching instructions.

Preferably, the first plate is in the shape of a parallelogram with a relatively short end edge and a side edge longer than the end edge. The stitching instructions comprise a stitch position indication mark that extends continuously along the end edge and the side edge mentioned above.

Other features and advantages of the present invention will become more apparent from the following detailed description taken with the accompanying drawings.

DETAILED DESCRIPTION OF THE PREFERRED EMBODIMENT

Preferred embodiments of the present invention will now be described below with reference to the drawings.

Figure 1:
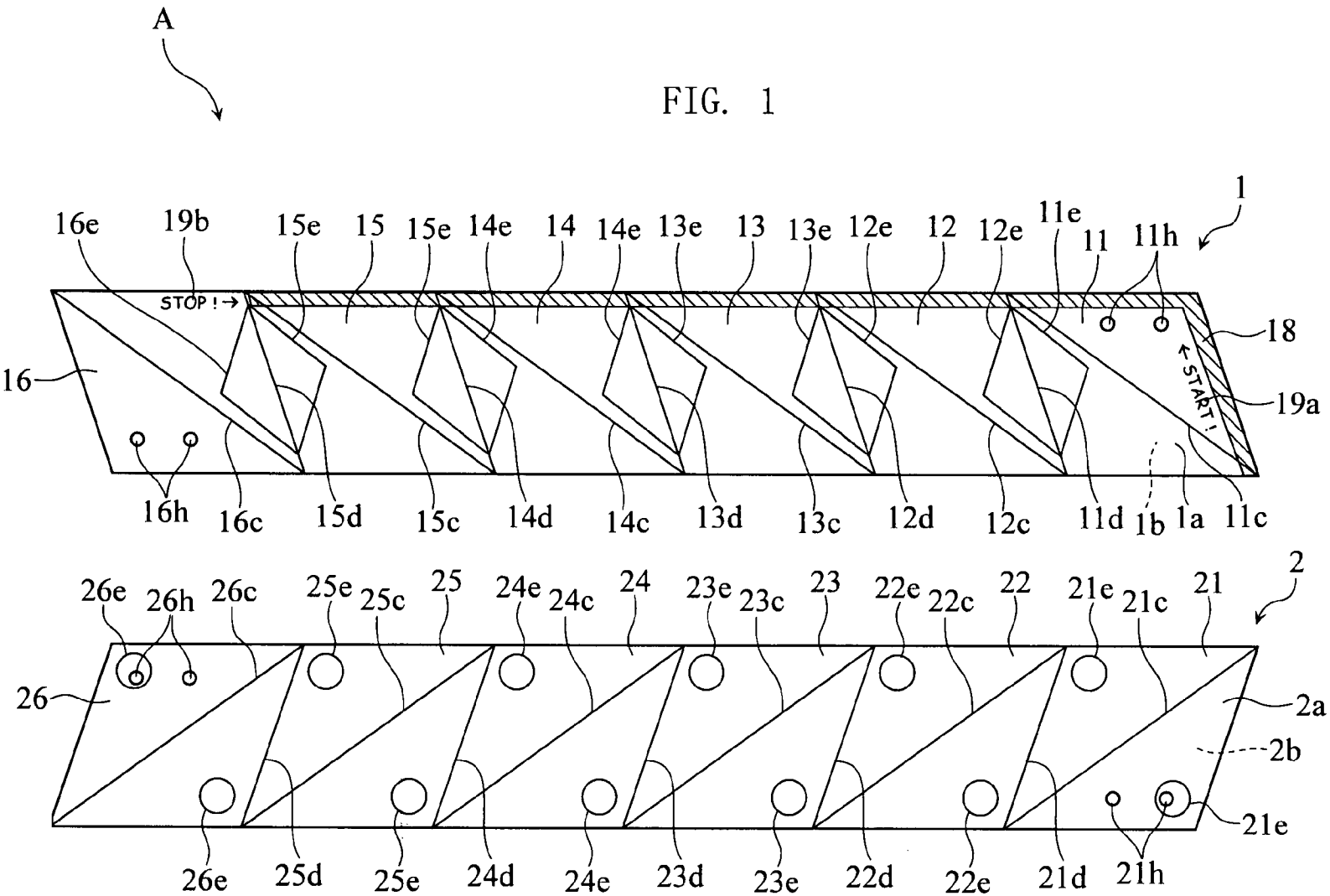
FIG. 1 is an expansion plan view showing an example of a handicraft assisting tool according to the present invention.

FIG. 1 is an expansion plan view showing an example of a handicraft assisting tool according to the present invention. As shown in the diagram, a handicraft assisting tool A of the present invention has an outer plate 1 and an inner plate 2 of the same size in a pair. As described hereinafter, this handicraft assisting tool A is used when stitching rectangular fabrics together into a pouch to create a coil rose.

The outer plate 1 and the inner plate 2 are each obtained by laminating a resin film on one side of a nonwoven sheet. The outer plate 1 has a film face 1*a* (outer face) and nonwoven face 1*b* (inner face), and the inner plate 2 has a film face 2*a* (outer face) and nonwoven face 2*b* (inner face).

The outer plate 1 is entirely in the shape of a parallelogram in which six unit pieces 11 to 16 of the same size are connected and stretched in a certain direction. Each of the unit pieces has a rhombus shape (that is, a quadrangle having four sides of the same length). On the film face 1*a*, folding indication lines 11*c* to 16*c* are shown along diagonal lines of the rhombic unit pieces 11 to 16 respectively. These folding indication lines can be displayed by printing them. Also, folding indication lines 11*d* to 15*d* are each shown along the borderline between adjacent unit pieces.

Folding direction indication marks 11*e* to 16*e* are displayed on the film face 1*a* by, for example, printing them. These marks are to indicate the folding directions of the folding indication lines 11*d* to 15*d*, respectively. The folding direction indication marks 11*e* to 16*e* are each disposed on each side of each of the folding indication lines 11*d* to 15*d* so as to form a pair. For example, a pair of folding direction indication marks 11*e*, 12*e* is positioned so as to hold the folding indication line 11*d* therebetween, and another pair of folding direction indication marks 12*e*, 13*e* is positioned so as to hold the folding indication line 12*d* therebetween.

Moreover, the film face 1*a* is provided with a stitch position indication mark 18 (shown by hatched lines in the drawing) that can be displayed by, for example, printing it. In FIG. 1 the stitch position indication mark 18 extends continuously from the rightmost unit piece 11 to the fifth unit piece 15. Specifically, the stitch position indication mark 18 extends along adjacent two sides of the first unit piece 11 (the two sides outside the folding indication line 11*c*) and extends along one side of each of the second to fifth unit pieces 12 to 15 (the upper sides in FIG. 1). The stitch position indication mark 18 is to show the position for stitching the fabrics together. In the present embodiment, a start indicator 19*a* for showing the position to start stitching and a stop indicator 19*b* for showing the position to stop stitching are provided in addition to the stitch position indication mark 18. Such a configuration is preferred for improving the usability of the handicraft assisting tool A.

In the outer plate 1, a pair of through-holes 11*h* is formed on the first unit piece 11. Similarly, a pair of through-holes 16*h* is formed on the sixth unit piece 16. The through-holes 11*h* are disposed along the upper side of the first unit piece 11, while the through-holes 16*h* are disposed along the lower side of the sixth unit piece 16.

As with the outer plate 1, the inner plate 2 is entirely in the shape of a parallelogram in which six rhombic unit pieces 21 to 26 of the same size are connected and stretched in a certain direction. Each of the unit pieces 21 to 26 is the same size as each of the unit pieces 11 to 16 of the outer plate 1. On the film face 2*a*, folding indication lines 21*c* to 26*c* are displayed by, printing them, in the form of diagonal lines of the unit pieces 21 to 26 respectively. Also, folding indication lines 21*d* to 25*d* are each shown along the borderline between adjacent unit pieces.

Folding direction indication marks 21*e* to 26*e* are displayed on the film face 2*a* by, for example, printing them. The folding direction indication marks 21*e* to 26*e*, which are to indicate the folding directions of the folding indication lines 21*c* to 26*c* respectively, are each disposed on each side of each of the folding indication lines 21*c* to 26*c* so as to form a pair. For example, the folding direction indication marks 21*e*, 22*e* is disposed away from each other so as to hold the folding indication line 21*c* therebetween, and the pair of folding direction indication marks 22*e*, 22*e* is disposed away from each other so as to hold the folding indication line 22*c* therebetween.

The first unit piece 21 (the rightmost unit piece in FIG. 1) and sixth unit piece 26 (the leftmost unit piece) of the inner plate 2 have a pair of through-holes 21*h* and a pair of through-holes 26*h*, respectively. These pairs of through-holes 21*h*, 26*h* are disposed so as to communicate with the pairs of through-holes 11*h*, 16*h* of the outer plate 1 when the outer plate 1 and the inner plate 2 are overlapped each other so that the film faces 1*a*, 2*a* become the external surfaces.

Figure 2:
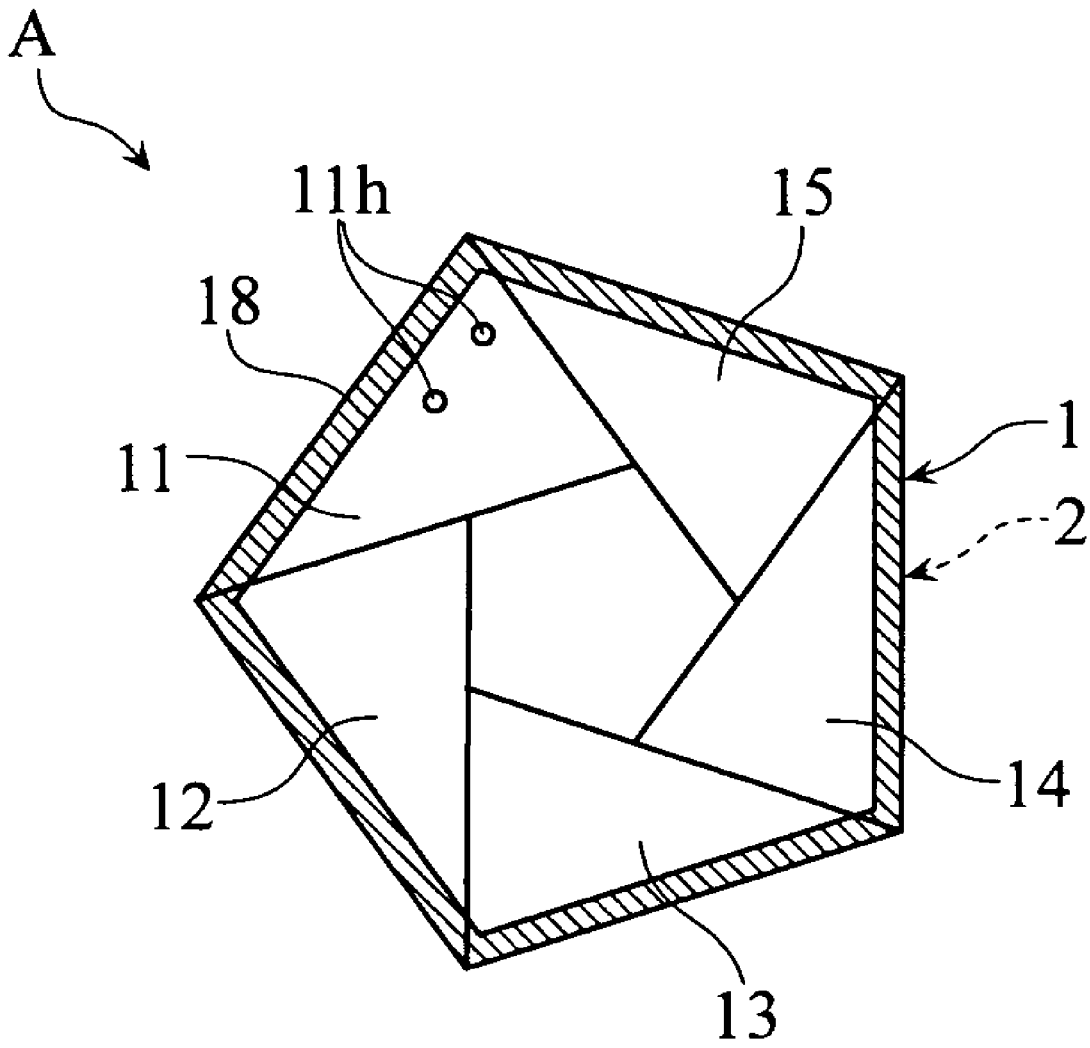
FIG. 2 is a plan view showing a state in which the handicraft assisting tool of FIG. 1 is folded.

Folding creases along the folding indication lines 11*c* to 16*c*, 11*d* to 15*d* are provided beforehand in the outer plate 1, and folding creases along the folding indication lines 21*c* to 26*c*, 21*d* to 25*d* are provided beforehand in the inner plate 2. There are two types of folding creases: a folding crease for "a mountain fold" and a folding crease for "a valley fold." A crest is formed on the fabric by folding it along the folding crease for a mountain fold, and a valley floor is formed on the fabric by folding it along the folding crease for a valley fold. After the outer plate 1 and inner plate 2 are overlapped each other so that the film faces 1*a*, 2*a* become the external surfaces, the overlapped fabric is folded to form mountain folds or valley folds along the folding indication lines. Consequently, a regular pentagon shown in FIG. 2 can be obtained.

Next, a method for creating a coil rose using the above-mentioned handicraft assisting tool A is described with reference to FIG. 3 to FIG. 12.

Figure 3:
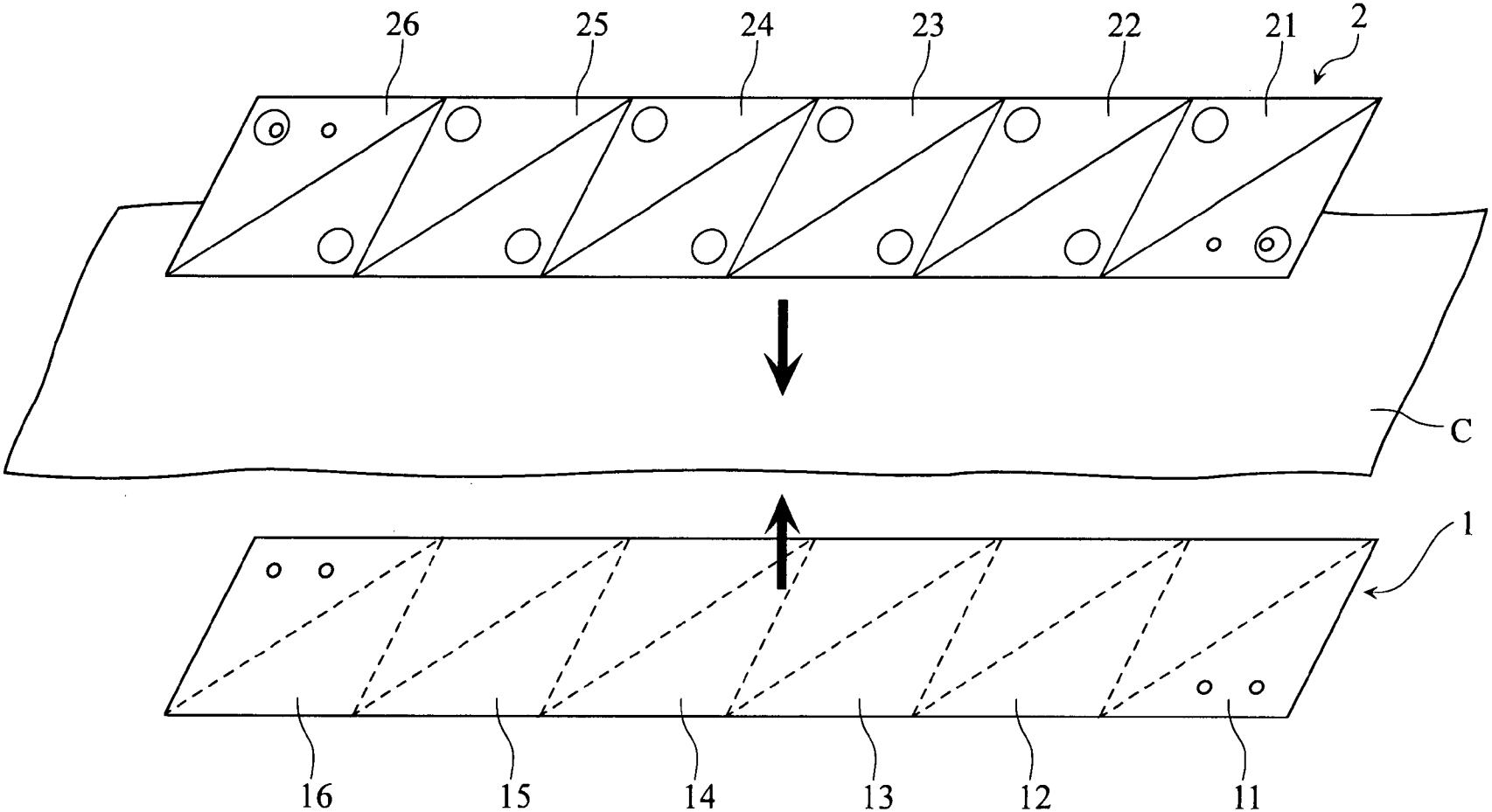
FIG. 3 is a diagram for explaining a procedure of a method for using the handicraft assisting tool shown in FIG. 1.

First, as shown in FIG. 3, a fabric C larger than the outer plate 1 and inner plate 2 is prepared and then placed between the outer plate 1 and the inner plate 2. In so doing, for example, the outer plate 1 is placed on the lower side of the fabric C and the inner plate 2 is placed on the upper side of the fabric C so that the film faces 1*a*, 2*a* become the external surfaces (exposed surfaces) (in FIG. 3, the film face 1*a* is placed face down and the film face 2*a* is placed face up).

Figure 4:
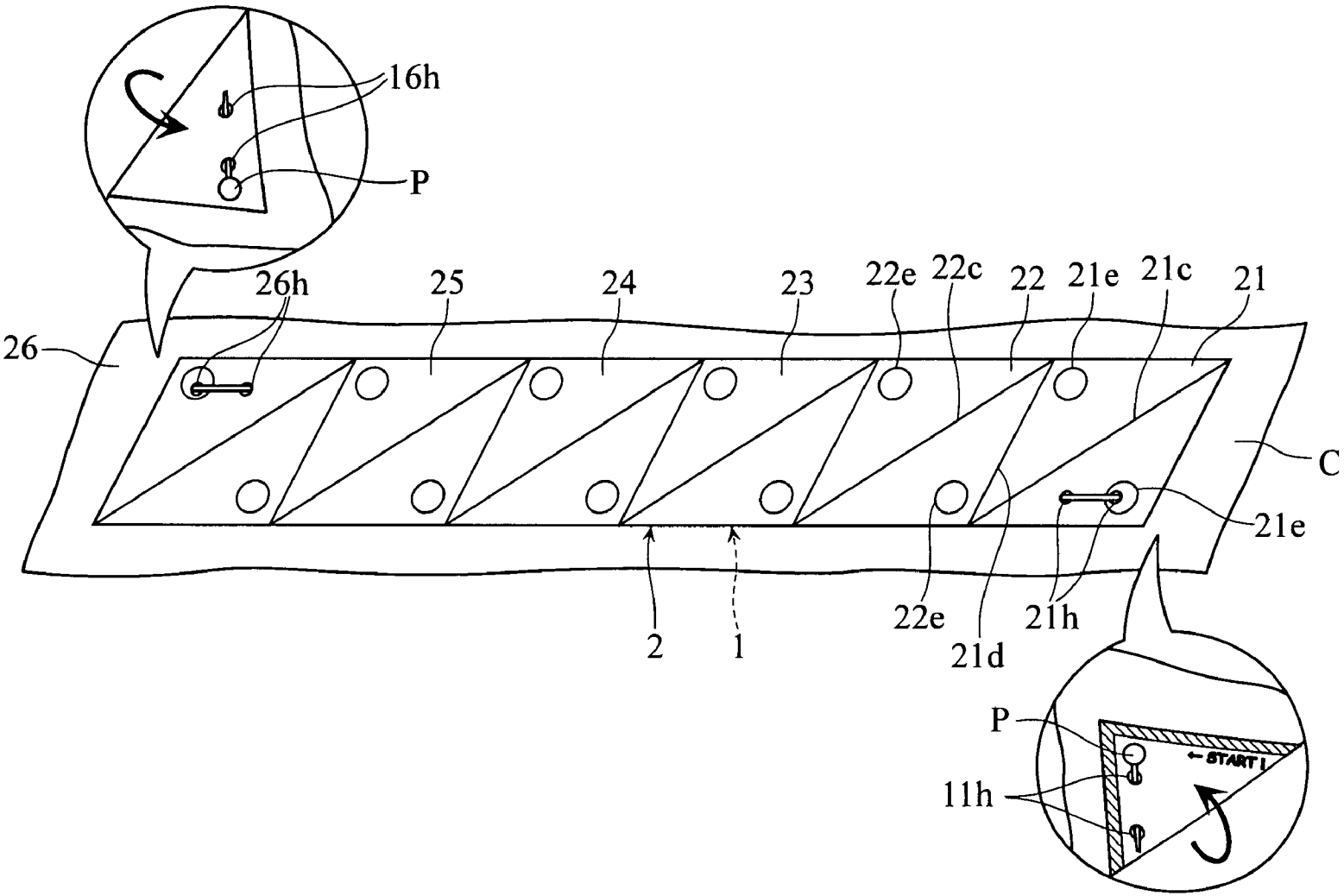
FIG. 4 is a diagram for explaining a procedure of the method for using the handicraft assisting tool shown in FIG. 1.

Next, as shown in FIG. 4, the outer plate 1 and inner plate 2 are overlapped each other with respective peripheral edges thereof being aligned closely. Here, marking pins P are inserted into the through-holes 11*h*, 21*h* on one side of the respective plates 1, 2 and into the through-holes 16*h*, 26*h* on the other side so that the fabric C is not removed from the plates 1, 2. Then, an unwanted part of the fabric C is cut off leaving a certain width of seam allowance (e.g., approximately 2 cm) along the peripheral edges of the plates 1, 2.

Figure 5:
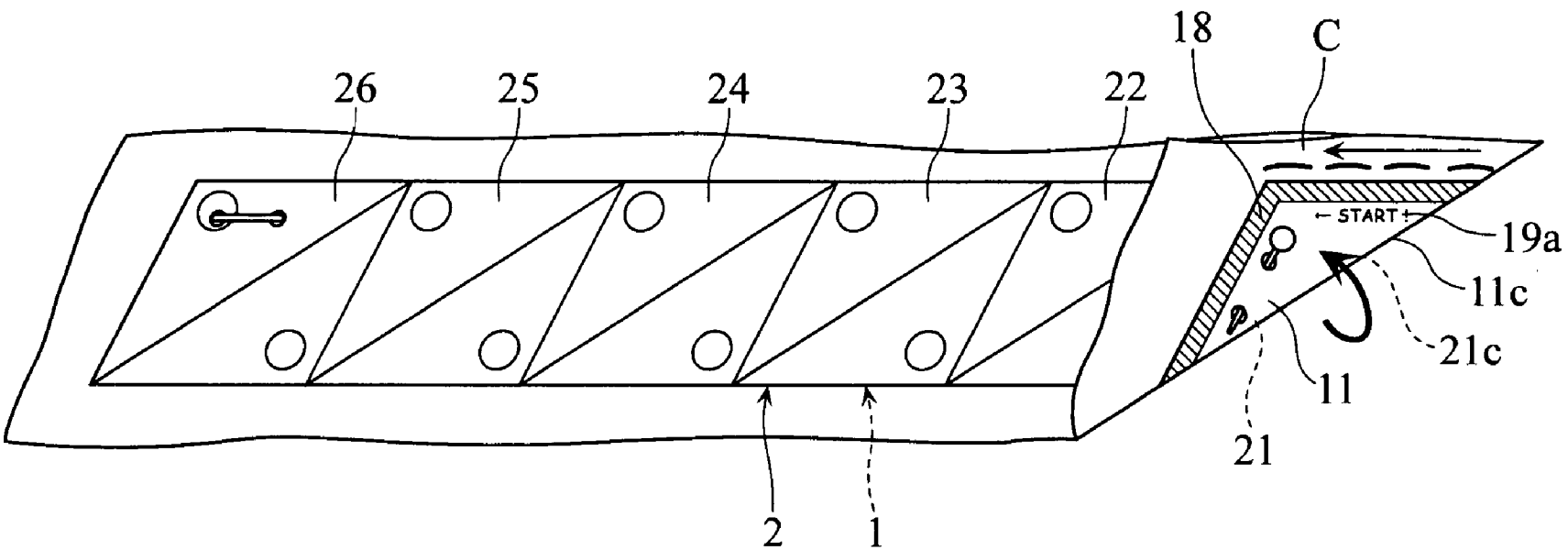
FIG. 5 is a diagram for explaining a procedure of the method for using the handicraft assisting tool shown in FIG. 1.

Next, as shown in FIG. 5, the unit pieces 11, 12 of the respective plates 1, 2 are folded along the folding indication lines 11*c*, 21*c*. The folding directions at this moment are the directions where a pair of folding directions indication marks 21*e*, 21*e* (see FIG. 4) join together. Accordingly, the unit piece 21 is folded along the folding indication line 21*c* into a valley shape, and the unit piece 11 is folded along the folding indication line 11*c* into a mountain shape. Because the plates 1, 2 have the folding creases that are formed beforehand along the folding indication lines of these plates as described above, the unit pieces 11, 21 can be folded easily in the right directions.

The fabric C placed between the two plates 1, 2 is folded by folding the unit pieces 11, 21 in a manner described above. In this state, the overlapped seam allowances of the fabric C are stitched together along the stitch position indication mark 18 from an end of a stitching operation start indicator 19*a*. This stitching is performed up to the point of the first angle (top) of the rhombic unit piece as shown in FIG. 5. Each stitch here is, for example, approximately 1 cm long.

Figure 6:
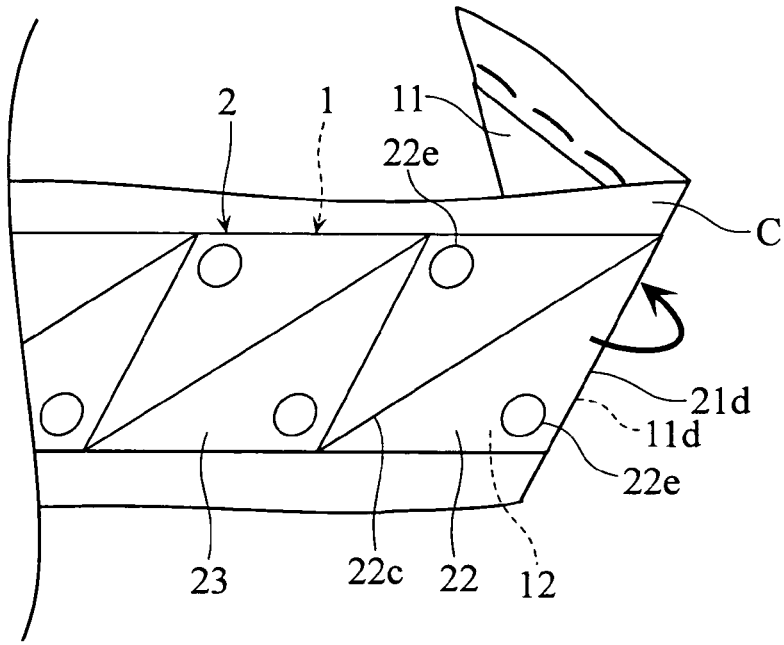
FIG. 6 is a diagram for explaining a procedure of the method for using the handicraft assisting tool shown in FIG. 1.
Figure 7:
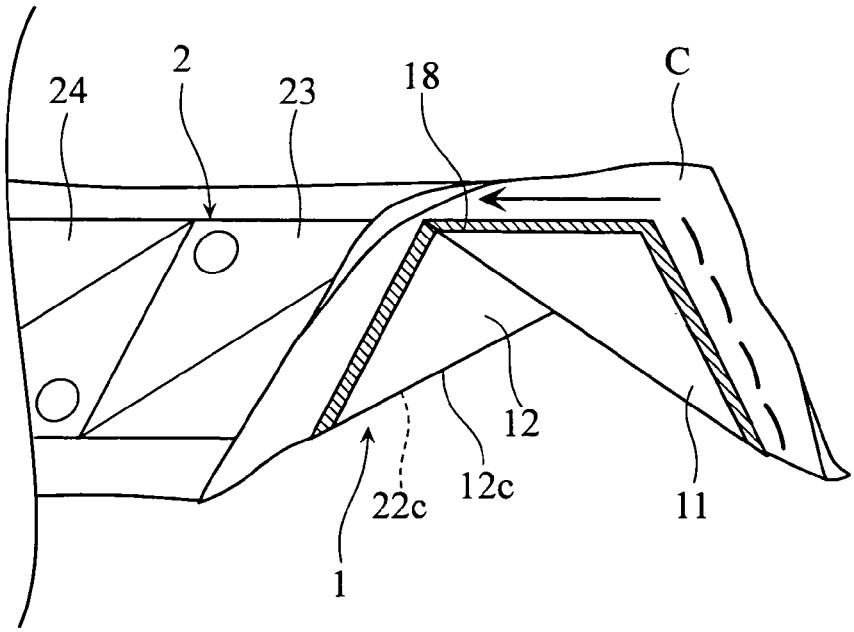
FIG. 7 is a diagram for explaining a procedure of the method for using the handicraft assisting tool shown in FIG. 1.

Next, as shown in FIG. 6 and FIG. 7, the plates 1, 2 are folded to alternately into the mountain shape and valley shape in this order along the folding indication lines 21*d*, 22*c* of the plate 2. Specifically, the plate 2 is folded along the folding indication line 21*d* into the mountain shape so that the folding direction indication marks 11*e*, 12*e* (see FIG. 1) join together as shown in FIG. 6 (at the same time the plate 1 is folded along the folding indication line 11*d* into the valley shape). Next, the plate 2, (unit piece 22) is folded along the folding indication line 22*c* into the valley shape so that the folding direction indication marks 22*e*, 22*e* (see FIG. 6) join together as shown in FIG. 7 (at the same time the unit piece 12 of the plate 1 is folded along the folding indication line 12*c* into the mountain shape). Then, as shown by the arrow in FIG. 7, the seam allowances of the fabric C are stitched together along the stitch position indication mark 18 up to the position of the next angle.

Figure 8:
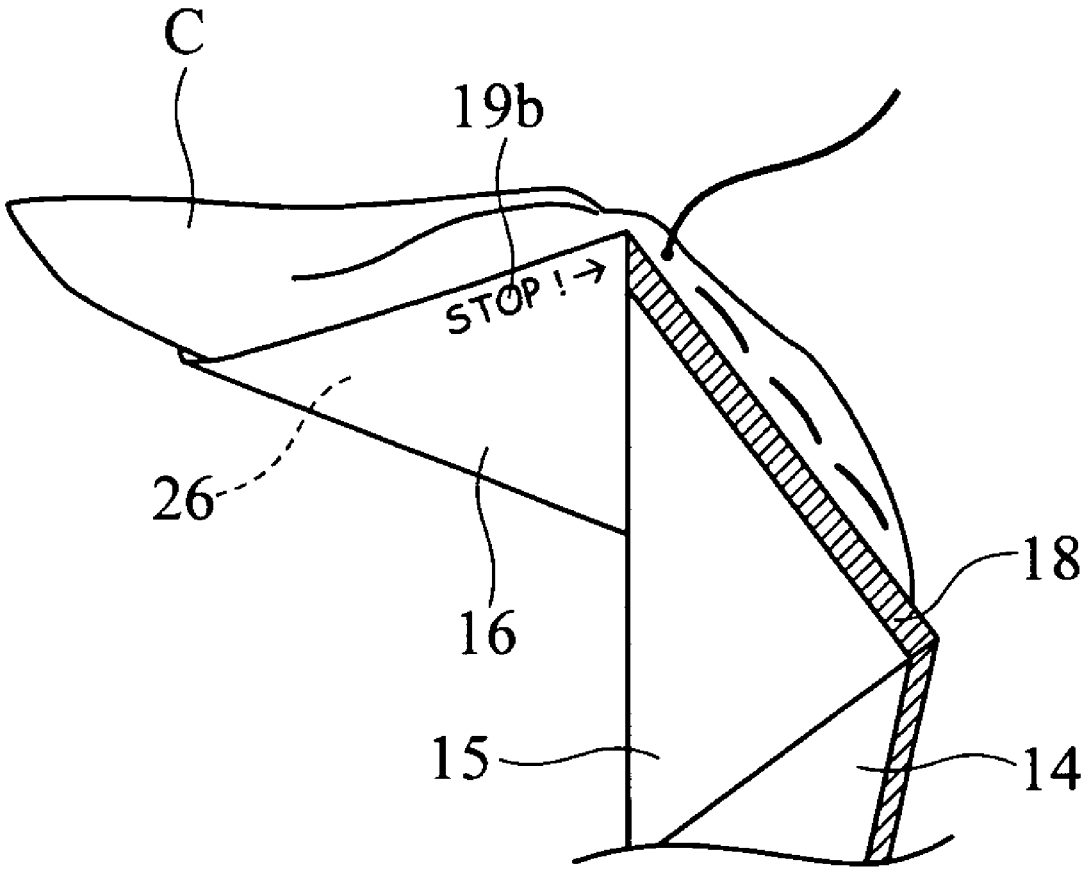
FIG. 8 is a diagram for explaining a procedure of the method for using the handicraft assisting tool shown in FIG. 1.

Thereafter, the above-described folding operation and stitching operation are repeated for the unit pieces 13 to 16 and 23 to 26. Then, after the seam allowances of the fabric C are stitched together up to the position of the stitching operation stop indicator 19*b* as shown in FIG. 8, the needle and the two marking pins P (see FIG. 4) are removed.

Figure 9:
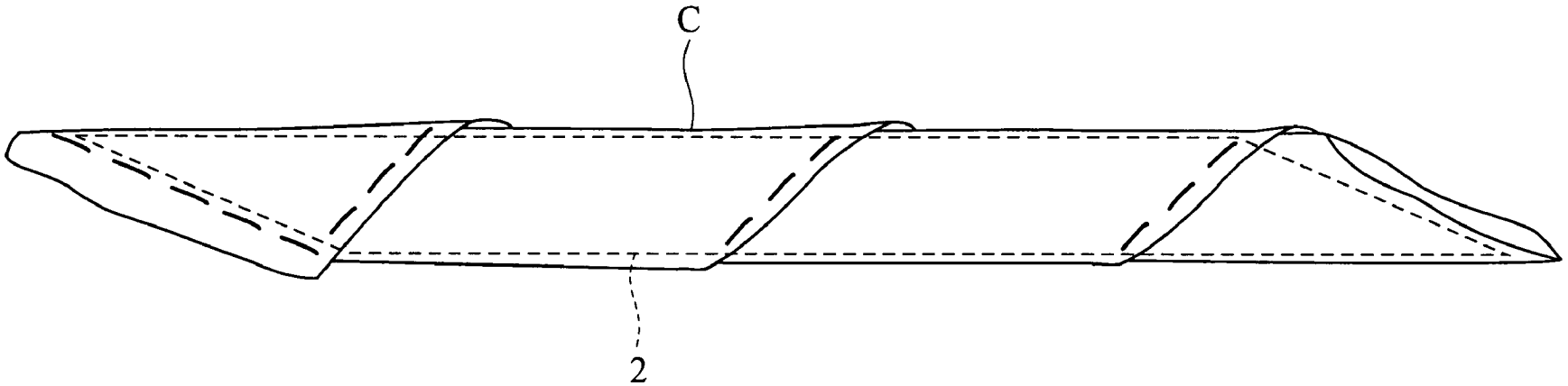
FIG. 9 is a plan view showing a pouch-like fabric that is created using the handicraft assisting tool shown in FIG. 1.

Next, the outer plate 1 is released and the fabric C (along with the inner plate 2 wrapped therein) is straightened, as shown in FIG. 9. In this state, the fabric C has been stitched to form a pouch, and the stitches of the fabric C has been stretched in a spiral manner. The end portion corresponding to the unit piece 26 of the pouch-like fabric C (the right end portion in FIG. 9) has not been stitched together and, therefore, is opened. The inner plate 2 is extracted through this opened portion, and then the opening portion is stitched together and closed. Note that the fabric C may be reversed to extract the inner plate 2. In this case, the seam allowances become invisible from the outside because the seam allowances are positioned on the inside of the pouch-like fabric C.

Figure 10:
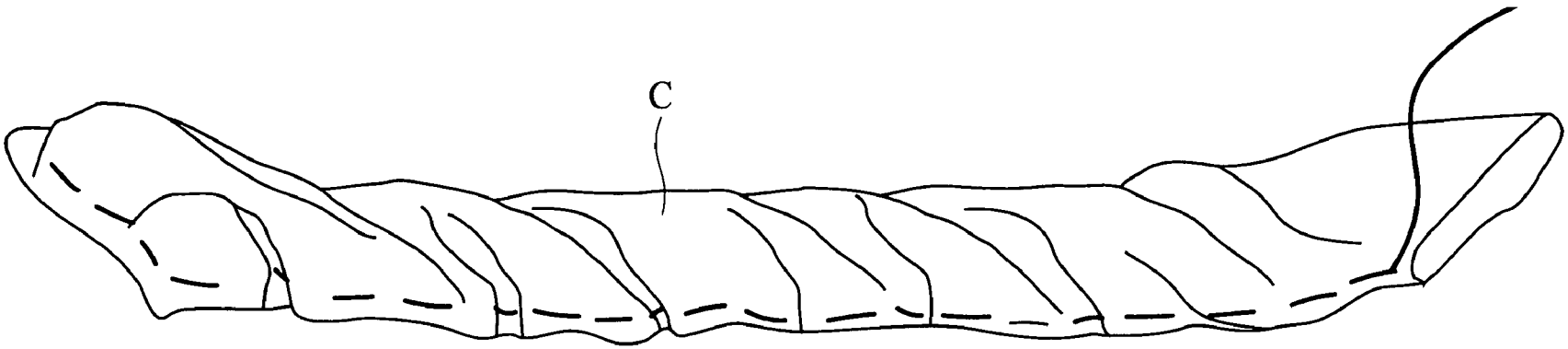
FIG. 10 is a diagram showing the pouch-like fabric in which stitches are aligned in a straight line.

Next, the pouch-like fabric C is twisted appropriately around the longitudinal axis center of the fabric C so that the spiral stitches extend substantially straight, as shown in FIG. 10. Consequently, a plurality of wrinkles are formed on the fabric C.

Figure 11:
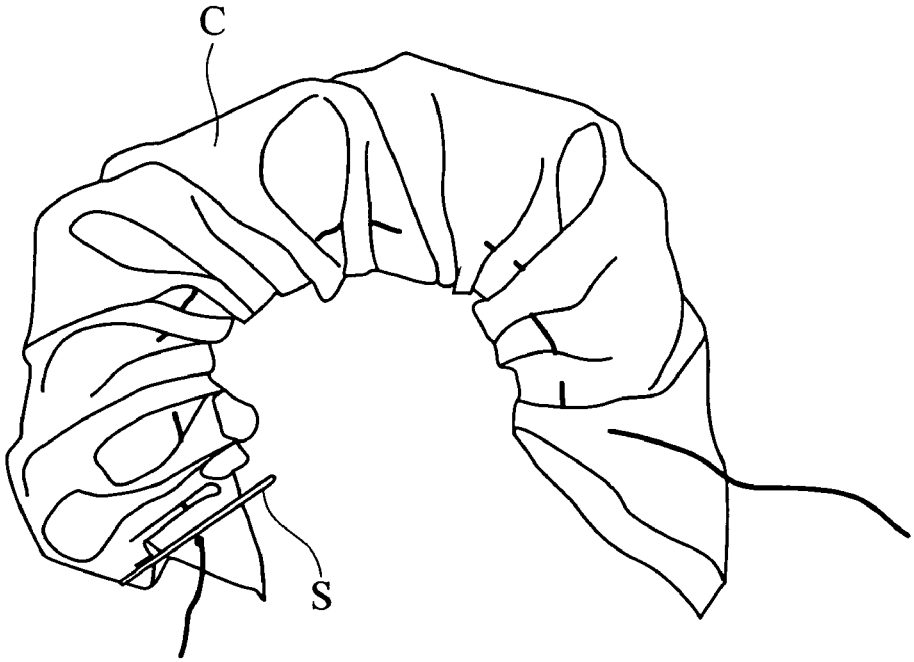
FIG. 11 is a diagram showing a state in which the pouch-like fabric shown in FIG. 10 is gathered.
Figure 12:
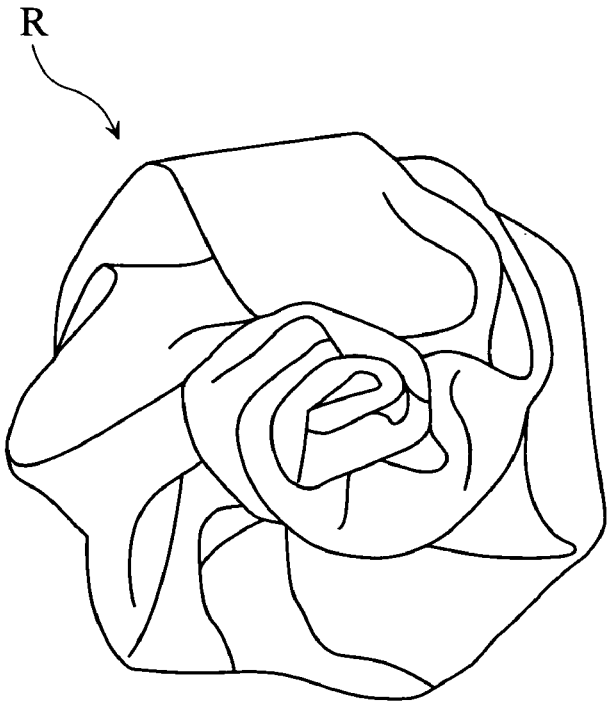
FIG. 12 is a plan view showing an example of a coil rose that is created using the handicraft assisting tool shown in FIG. 1.

Next, as shown in FIG. 11, a rod-like core material S is attached to an end portion of the fabric C and the stitching thread is pulled to make appropriate gathering. A bobby pin, for example, may be used as the core material S.

Next, the fabric C is gently wrapped around the core material S and a lower section of the fabric C (section in the vicinity of the stitches) is stitched in order to keep the wrapped state of the fabric C. Finally, the core material S is removed. In this manner, a coil rose R shown in FIG. 12 can be obtained.

A coil rose having a substantially fixed shape and size can be created easily by using the handicraft assisting tool A of the present invention. Also, as described with reference to FIG. 9 and FIG. 10, a plurality of wrinkles are formed on the pouch-like fabric C. Therefore, the resulting coil rose R can project a three-dimensional feature with overlapping petals, as in an actual rose. Specifically, according to the present invention, the fabric C used as the material does not have to be a fabric that is cut in a bias direction. Therefore, the fabric C may be the one that is cut in a direction of vertical or horizontal yarn. Such a fabric is preferred in terms of efficient use of the material.

In the above embodiment, the plate 1 is provided with the folding indication lines 11*c* to 16*c* and 11*d* to 15*d* and folding direction indication marks 11*e* to 16*e*, and the plate 2 is provided with the folding indication lines 21*c* to 26*c* and 21*d* to 25*d* and folding direction indication marks 21*e* to 26*e*. Also, the folding creases for mountain folds and valley folds are provided beforehand along the folding indication lines 11*c* to 16*c* and 11*d* to 15*d* for the plate 1 and along the folding indication lines 21*c* to 26*c* and 21*d* to 25*d* for the plate 2. The folding indication lines, folding direction indication marks and folding creases function as the folding operation instructions. With such a configuration, a worker can grasp the procedure of the folding operation of the plates 1, 2 in order to perform the folding operation of the plates 1, 2 promptly and accurately.

The outer and inner plates 1 and 2 have the nonwoven faces 1*b* and 2*b* as inner faces. The fabric C is held between the two plates 1, 2 and thereby abuts on the nonwoven faces 1*b*, 2*b* (see FIG. 3). According to such a configuration, the fabric C held between the plates 1, 2 can be appropriately prevented from being shifted during the step of folding back each part on the two plates 1, 2.

The shape of each unit piece of the outer plate 1 and of the inner plate 2 may be a rhombus shape with 90° inner angles (i.e., a square). Also, the number of unit pieces of each of the plates 1, 2 is not limited to six but may be increased or decreased appropriately.

The invention claimed is:

1. A handicraft assisting tool for stitching a fabric having a first face and second face into a pouch, the handicraft assisting tool comprising:

a first plate including a plurality of rhombic unit pieces of a same size arranged in a row, and an inner face that abuts on the first face of the fabric;

a second plate including a plurality of rhombic unit pieces of a same size arranged in a row, and an inner face that abuts on the second face of the fabric;

wherein each of the unit pieces of the first plate is same in size as each of the unit pieces of the second plate; and wherein the first plate and second plate are each provided with folding operation instructions for folding these plates along a diagonal line of each unit piece and a borderline between adjacent unit pieces.

2. The handicraft assisting tool according to claim 1, wherein the folding operation instructions comprise folding indication lines and folding direction indication marks, the folding indication lines being shown along the diagonal line and the borderline, the folding direction indication marks being shown on both sides of the folding indication line for showing folding directions of the folding indication lines.

3. The handicraft assisting tool according to claim 1, wherein the folding operation instructions comprise folding creases provided along the diagonal line and the borderline to form either a mountain fold or a valley fold.

4. The handicraft assisting tool according to claim 1, wherein the first plate has an end portion formed with a pair of first through-holes, and the second plate has an end portion formed with a pair of second through-holes, the first through-holes being configured to communicate with the second through-holes when the first plate and the second plate overlap each other.

5. The handicraft assisting tool according to claim 1, wherein the inner faces of the first plate and the second plate are each provided with a slip stopper.

6. The handicraft assisting tool according to claim 1, wherein the first plate has an outer face opposite to the inner face of the first plate, the outer face being provided with stitching instructions.

7. The handicraft assisting tool according to claim 6, wherein the first plate has a parallelogram shape with a relatively short end edge and a side edge longer than the end edge, and the stitching instructions include a stitch position indication mark extending continuously along the end edge and the side edge.

* * * * *